US010612336B2

(12) United States Patent
Lewis et al.

(10) Patent No.: US 10,612,336 B2
(45) Date of Patent: Apr. 7, 2020

(54) ROTATING CONTROL DEVICE

(71) Applicant: Halliburton Energy Services, Inc., Houston, TX (US)

(72) Inventors: Derrick W. Lewis, Conroe, TX (US); Chris A. Grace, Coppell, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 572 days.

(21) Appl. No.: 15/316,623

(22) PCT Filed: Feb. 16, 2015

(86) PCT No.: PCT/US2015/016001
§ 371 (c)(1),
(2) Date: Dec. 6, 2016

(87) PCT Pub. No.: WO2016/028340
PCT Pub. Date: Feb. 25, 2016

(65) Prior Publication Data

US 2017/0191333 A1 Jul. 6, 2017

Related U.S. Application Data

(60) Provisional application No. 62/040,351, filed on Aug. 21, 2014.

(51) Int. Cl.
*E21B 33/035* (2006.01)
*E21B 33/08* (2006.01)
(Continued)

(52) U.S. Cl.
CPC ..... *E21B 33/035* (2013.01); *E21B 4/003* (2013.01); *E21B 17/01* (2013.01); *E21B 33/076* (2013.01); *E21B 33/085* (2013.01); *E21B 44/00* (2013.01)

(58) Field of Classification Search
CPC ..... E21B 17/01; E21B 33/035; E21B 33/076; E21B 33/085; E21B 44/00; E21B 4/003
See application file for complete search history.

(56) References Cited

U.S. PATENT DOCUMENTS 4,593,774 A * 6/1986 Lingafelter ..... E21B 4/003 175/107
6,230,824 B1 5/2001 Peterman et al.
(Continued)

FOREIGN PATENT DOCUMENTS

WO WO 2007/047800 A2 4/2007
WO WO 2013/185227 A1 12/2013
WO WO 2014/042631 A1 3/2014

OTHER PUBLICATIONS

International Search Report and the Written Opinion of the International Search Authority, or the Declaration, Jun. 4, 2015, PCT/US2015/016001, 19 pages, ISA/KR.
(Continued)

*Primary Examiner* — James G Sayre
(74) *Attorney, Agent, or Firm* — Haynes and Boone, LLP

(57) ABSTRACT

A drilling system, rotating control device, and a method for accessing a wellbore may employ a rotating control device arranged to form a dynamic seal between the housing and an exterior of the string to isolate the wellbore annulus under both a positive and a negative differential pressure across the seal. The rotating control device may including a sleeve rotatively disposed within the housing and rotatively carried near a longitudinal midpoint of the sleeve by a thrust bearing assembly. One or more seal retainers may be coupled to and sealed against the sleeve, each including a resilient element disposed to slide to a first sealing position within the seal retainer under a positive differential pressure across the
(Continued)

element and to slide to a second sealing position within the seal retainer under a negative differential pressure across the element.

13 Claims, 6 Drawing Sheets

(51) Int. Cl.

| | |
|---|---|
| ***E21B 4/00*** | (2006.01) |
| ***E21B 17/01*** | (2006.01) |
| ***E21B 33/076*** | (2006.01) |
| ***E21B 44/00*** | (2006.01) |

(56) References Cited

U.S. PATENT DOCUMENTS

| | | | | |
|---|---|---|---|---|
| 7,487,837 | B2 | 2/2009 | Bailey et al. | |
| 7,836,946 | B2 | 11/2010 | Bailey et al. | |
| 8,286,734 | B2 | 10/2012 | Hannegan et al. | |
| 8,322,432 | B2 | 12/2012 | Bailey et al. | |
| 8,347,983 | B2 | 1/2013 | Hoyer et al. | |
| 8,544,535 | B2 | 10/2013 | Cote et al. | |
| 2007/0007012 | A1 | 1/2007 | Bartlett et al. | |
| 2008/0060846 | A1 | 3/2008 | Belcher et al. | |
| 2011/0036638 | A1 | 2/2011 | Sokol et al. | |
| 2012/0043089 | A1 | 2/2012 | Hoffman et al. | |
| 2012/0043726 | A1 | 2/2012 | Zubia et al. | |
| 2012/0085545 | A1 | 4/2012 | Tarique et al. | |
| 2013/0192847 | A1 | 8/2013 | Bailey et al. | |
| 2013/0341052 | A1 | 12/2013 | Bailey et al. | |
| 2014/0027129 | A1* | 1/2014 | Hannegan | E21B 33/085 166/387 |
| 2014/0069720 | A1 | 3/2014 | Gray | |
| 2015/0315845 | A1* | 11/2015 | Chambers | E21B 3/04 166/379 |

OTHER PUBLICATIONS

"Using Kalsi Seals in Rotating Control Devices," *Kalsi Seals Handbook*, Chapter E1, Oct. 16, 2015, https://www.kalsi.com/handbook/E01_Using_Kalsi_Seals_in_Rotating_Control_Devices.pdf.

* cited by examiner

ROTATING CONTROL DEVICE

PRIORITY

The present application is a U.S. National Stage patent application of International Patent Application No. PCT/US2015/016001, filed Feb. 16, 2015, entitled "ROTATING CONTROL DEVICE," and claims priority to U.S. Provisional Patent Application No. 62/040,351, also entitled, "ROTATING CONTROL DEVICE," filed Aug. 21, 2014, the disclosures of which are hereby incorporated by reference in their entirety.

FIELD

The present disclosure relates generally to oilfield equipment, and in particular to systems and techniques for drilling wellbores in the earth. More particularly still, the present disclosure relates in part to offshore drilling techniques and systems.

BACKGROUND

Various drilling methods and systems are known in the art. Most arrangements use a rotating drill bit that is carried and conveyed in the wellbore by a drill string, which is in turn carried by a drilling rig located above the wellbore. The drill bit may be rotated by rotation of the drill string and/or the drill string may include as part of a bottom hole assembly a downhole rotary motor for rotating the drill bit.

Drilling fluid is pumped to the drill bit through the drill string and is directed out of nozzles in the drill bit for cooling the bit and removing formation cuttings. The drilling fluid may also provide hydraulic power to downhole tools, such as a mud motor located in a bottom hole assembly (BHA) for rotating the drill bit. Drilling fluid or mud may also provide hydraulic pressure in the wellbore to prevent collapse of the wellbore and/or fluid entry from the formation to the wellbore. The drilling fluid and any entrained formation cuttings are forced from the bottom of the wellbore by the continued pumping of drilling fluid through the drill string and then carried upwards through the annulus that exists between the drill string and the wellbore wall.

In cases of drilling offshore wells, the drilling rig may be positioned above the surface of the water, generally over a wellhead. A riser may be provided between the drilling rig and the wellbore at the seafloor for allowing the drill string to be conveniently run into and tripped out of the wellbore. The riser may also provide an extension of the annular wellbore flow path for returning the drilling fluid and cuttings to the rig for processing and/or reuse.

The wellhead may carry a blowout preventer (BOP) stack, which may include ram BOPs and/or an annular BOP, for example. BOPs may include an axial passage to accommodate the drill string and may include one or more closure devices, such as shear, blind or pipe rams or elastomeric packers to shut in the wellbore in the case of an emergency. A rotating control device (RCD), also sometimes referred to by routineers as a rotating control head, rotating blowout preventer, or rotating diverter, may be carried atop the BOP stack for preventing escape of well annulus fluid into the environment.

BRIEF DESCRIPTION OF THE DRAWINGS

Embodiments are described in detail hereinafter with reference to the accompanying figures, in which.

DETAILED DESCRIPTION

Figure 1:
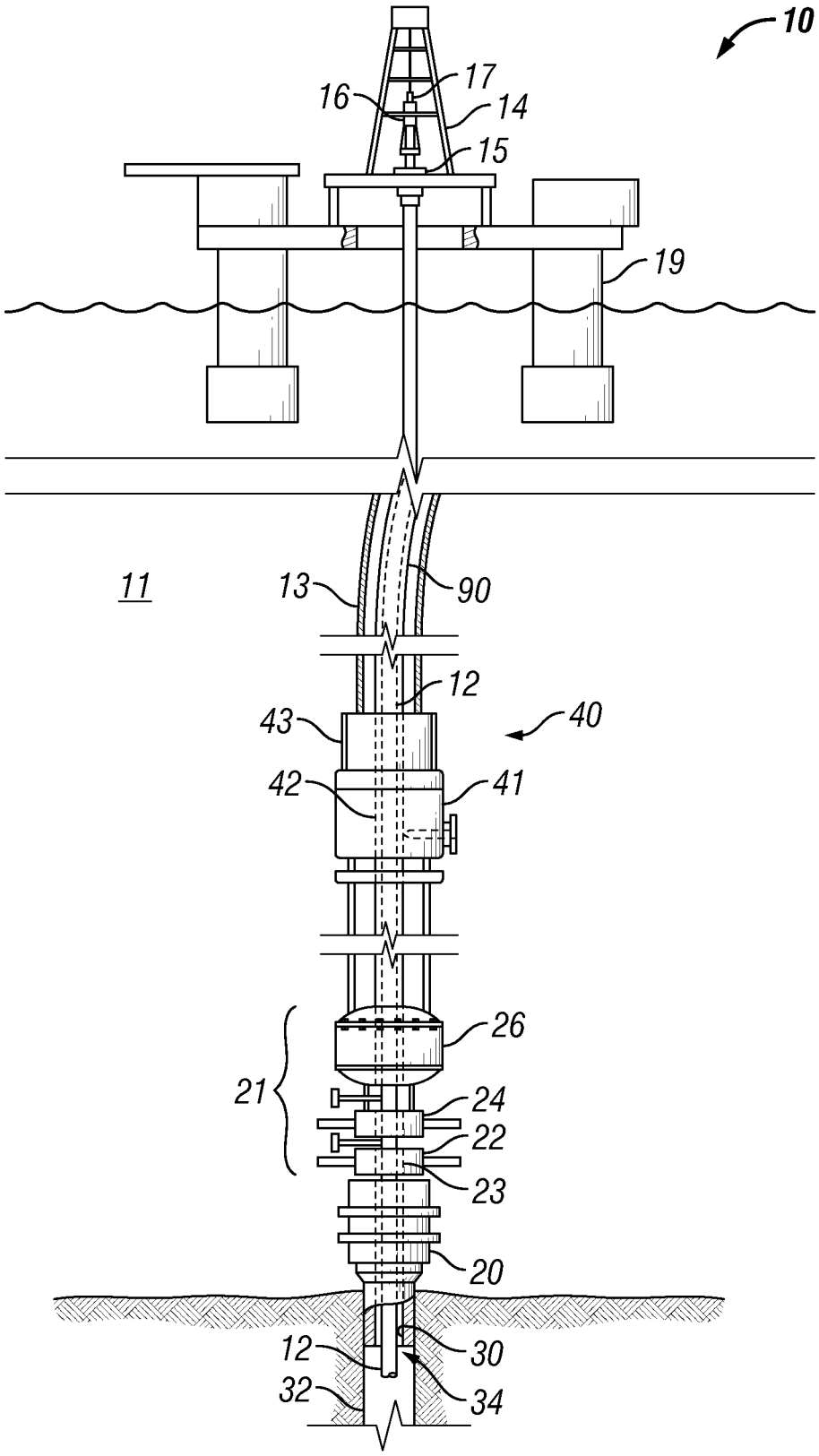
FIG. 1 is an elevation view in partial cross section of a drilling system, showing a drill string extending from an offshore platform to a wellhead and subsea stack at the seafloor with a rotating control device and associated support components according to an embodiment.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe relationships as illustrated in the figures. The spatially relative terms are intended to encompass different orientations of the apparatus in use or operation in addition to the orientation depicted in the figures.

FIG. 1 is an elevation view in partial cross section of a drilling system 10 according to an embodiment. Referring to FIG. 1, drilling system 10 may include a drilling rig 14, which may include a rotary table 15, a top drive unit 16, a hoist 17, and other equipment necessary for drilling a wellbore in the earth.

In the embodiment of FIG. 1, drilling system 10 may include an offshore platform 19 located at the surface of a body of water 11. Offshore platform 19 may be a tension leg platform, spar, semi-submersible, or drill ship, for example. In other embodiments, the drilling system of the present disclosure may be located onshore.

Drilling rig 14 may be located generally above a wellhead 20, which in the case of the offshore arrangement of FIG. 1 is located at the seafloor of body of water 11. Drilling rig 14 may suspend a drill string 12, which may extend downward through body of water 11, through a passage 30 formed through wellhead 20, and into the wellbore 32 that is being drilled. The annular region between the wall of wellbore 32 and the exterior wall of drill string 12 may define a wellbore annulus 34.

Wellhead 20 may carry a blowout preventer (BOP) stack 21, which may include ram BOPs 22, 24 and an annular BOP 26, for example. BOPs 22, 24, 26 may include an axial passage 23 to accommodate drill string 12 and may be arranged with closure devices, such as shear, blind or pipe rams in the case of ram BOPs 22, 24, or elastomeric packers, in the case of annular BOP 26, to shut in wellbore 32 in the case of an emergency.

A rotating control device (RCD) 40 may be carried atop BOP stack 21. However, RCD 40 may be also provided at any point between platform 19 and wellhead 20. RCD 40 may have a housing 41 with an axial passage 42 formed therethrough for accommodating drill string 12. RCD 40 may be an active- or passive-style device, and it may also take the form of an annular BOP.

A marine riser 13 may be connected between offshore platform 19 and RCD 40, through which drill string 12 may be guided into RCD 40, BOP stack 21, wellhead 20, and wellbore 32. The region between the interior of riser 13 and the exterior of drill string 12 may define a riser annulus. The riser annulus may include a fluid, which may be subject to hydrostatic pressure due to the column of fluid within the riser annulus.

According to an embodiment and as discussed in greater detail below with respect to FIG. 2, RCD 40 may be arranged to create a dynamic seal between the outer wall of drill string 12 and housing 41 so as to fluidly isolate wellbore annulus 34 from the riser annulus while allowing drill string 12 to axially translate and rotate when wellbore annulus pressure exceeds the hydrostatic pressure within the riser annulus. Additionally, at a sufficient water depth, the hydrostatic pressure in riser annulus above RCD 40 may exceed the wellbore annulus pressure below RCD 40. RCD 40 may therefore be arranged to also fluidly isolate the riser annulus from wellbore annulus 34 the under such conditions, while allowing drill string 12 to axially translate and rotate.

As used herein, "positive differential pressure" is defined as the wellbore annulus pressure exceeding pressure within the annulus of the riser. Likewise, "negative differential pressure" is defined as the pressure in riser annulus at the rotating control device exceeding the wellbore annulus pressure.

Figure 2:
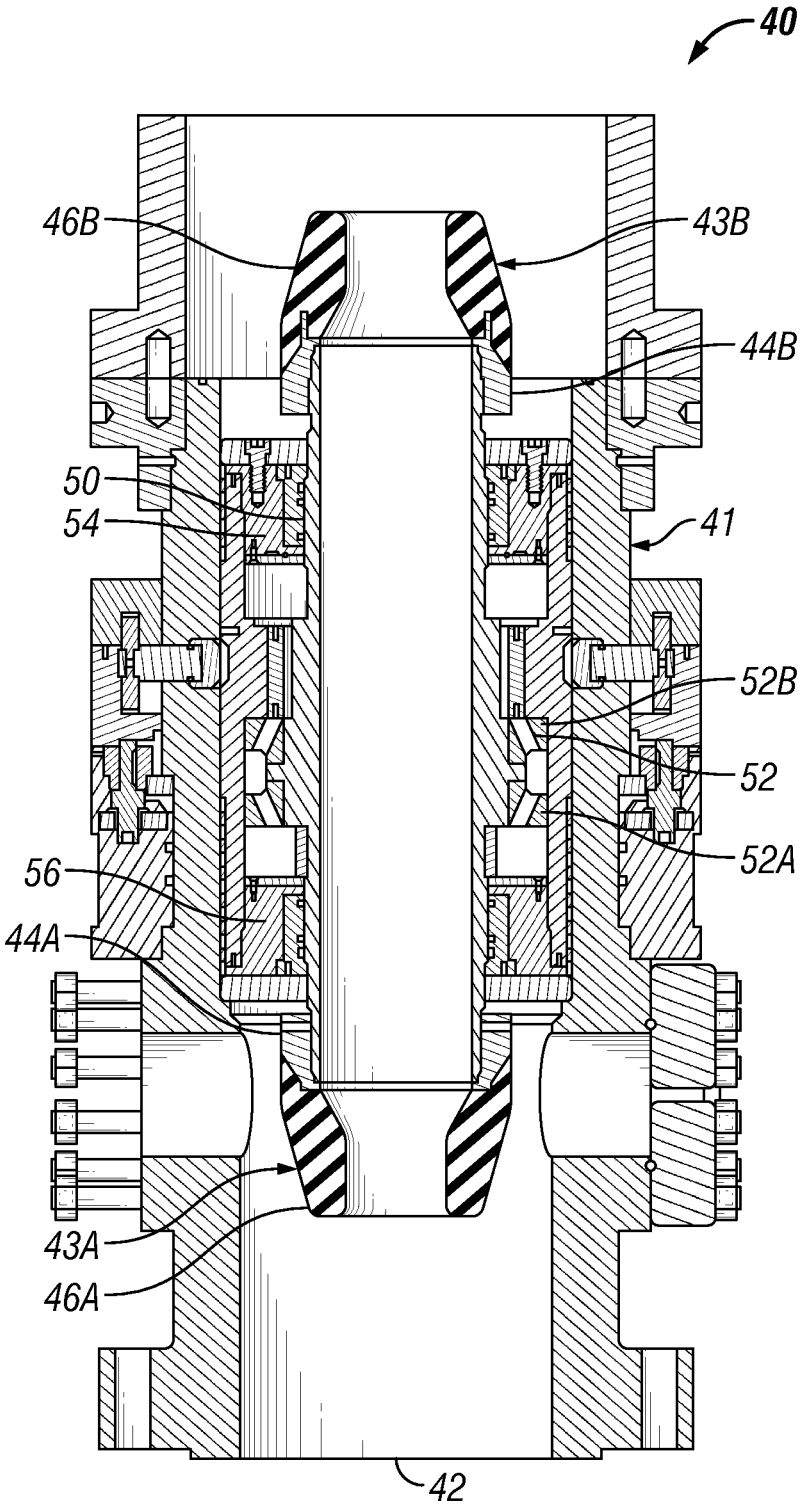
FIG. 2 is an axial cross section of a dual sealing rotating control device according to an embodiment, showing a sleeve rotatively carried within a housing and carrying an upper seal subassembly arranged to provide a seal against fluid ingress from above into the rotating control device and a lower seal subassembly arranged to provide a seal against well annulus fluid ingress into the rotating control device.

FIG. 2 is an elevation view in axial cross section of RCD 40 according to one or more embodiments. Referring to FIGS. 1 and 2, RCD 40 may be used to seal off wellbore annulus 34, which may be in fluid communication with passage 42 formed within housing 41 of RCD 40. Housing 41 may be sealed against the exterior wall of drill string 12 within passage 42, even while drill string 12 rotates and translates longitudinally therein. More particularly, RCD 40 may include a sleeve 50 that is rotatively mounted at or near a midpoint thereof within passage 42 by a single thrust bearing assembly 52. In one or more embodiments, thrust bearing assembly 52 may include a lower thrust bearing element 52A and an upper thrust bearing element 52B disposed in proximity to one another at or near the midpoint of sleeve 50. Upper and lower rotary seals 54, 56 may seal sleeve 50 against housing 41 and protect thrust bearing assembly 52. Sleeve 50 may be arranged to receive and seal against drill string 12 with one or more seal assemblies.

Referring to FIG. 2, according to an embodiment, sleeve 50 may carry a seal assembly, which may include one or more seal subassemblies 43 with one or more resilient annular sealing elements 46A, 46B to seal against the external wall of drill string 12 (FIG. 1). Sealing elements 46A, 46B may be made of an elastomeric or polymeric material, for example, which may allow drill string joints of varying outer diameter to pass through RCD 40 while maintaining a seal. Elements 46 may be mounted to retainers 44A, 44B, which in turn may be connected to sleeve 50. A lower seal subassembly 43A may be carried at a lower end of sleeve 50 and include a resilient element 46A, and an upper seal subassembly 43B may be carried at a lower end of sleeve 50 and include a resilient element 46B.

In an embodiment, lower seal subassembly 43A may be arranged to isolate wellbore annulus 34 when the wellbore annulus pressure exceeds the riser annulus pressure, that is, under a positive differential pressure. Upper seal subassembly 43B may be arranged to isolate wellbore annulus 34 when the riser annulus pressure exceeds the wellbore annulus pressure, that is, under a negative differential pressure. More particularly, the outer profiles of elements 46A, 46B may have a generally conical shape so that a differential pressure in the sealing direction acts to compress the element against the drill string to affect a seal. In some embodiments, upper seal subassembly 43B may be similar to lower seal subassembly 43A except inverted in orientation.

Figure 3:
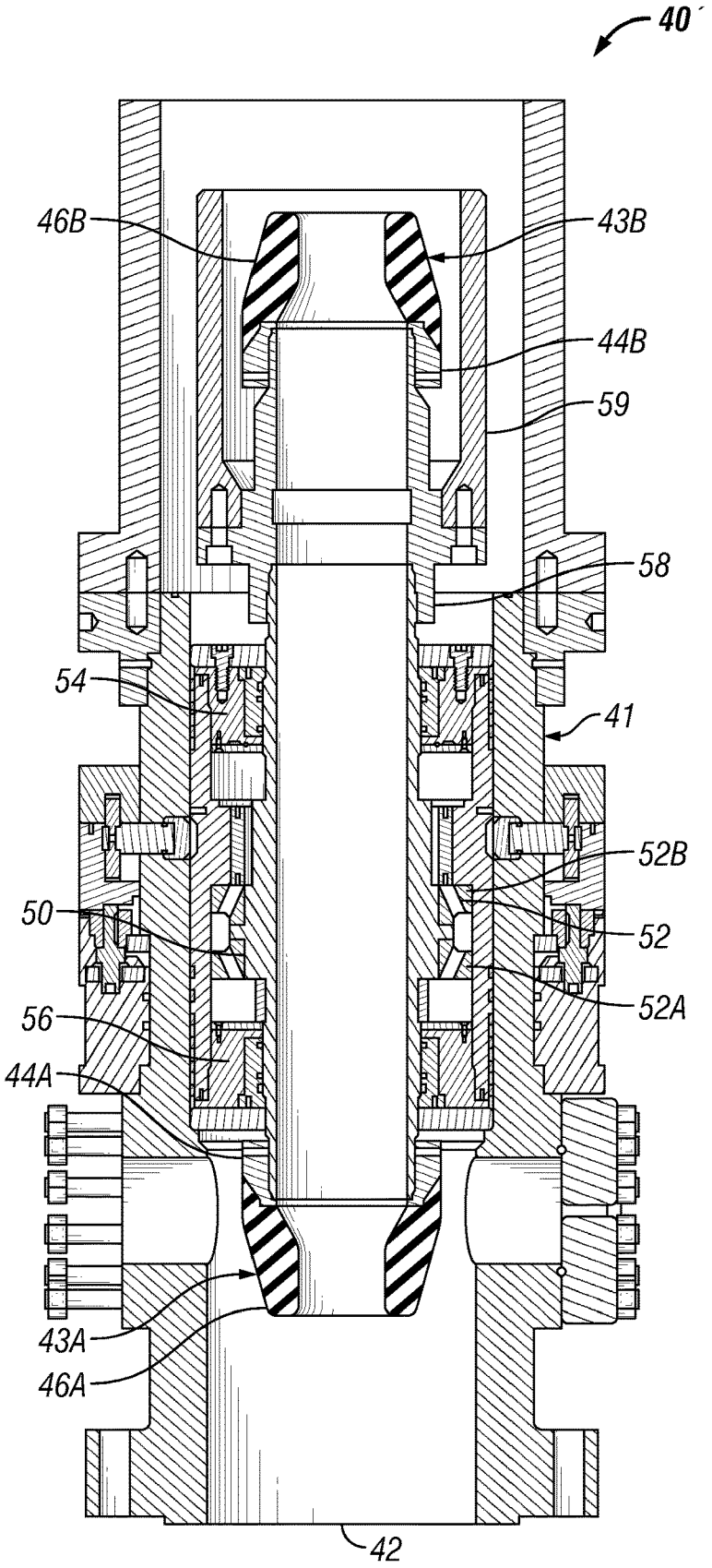
FIG. 3 is an axial cross section of a dual sealing rotating control device according to an embodiment, showing an upper seal subassembly carried by a rotatable sleeve via an extension member.

FIG. 3 illustrates an embodiment of RCD 40'. Sleeve 50 may carry a seal assembly, which may include one or more seal subassemblies 43 with one or more resilient annular sealing elements 46A, 46B to seal against the external wall of drill string 12 (FIG. 1). However, unlike the embodiment of FIG. 2, in which lower and upper seal subassemblies 43A, 43B may be carried directly at the lower and upper ends of sleeve 50 via retainers 44A, 44B, in the embodiment of FIG. 3, upper seal subassembly 43B may be connected to the upper end of sleeve 50 via retainer 44B and an extension 58. A shroud 59 may be connected to extension 58 and at least partially surround seal subassembly 43B.

Sealing elements 46A, 46B may be made of an elastomeric or polymeric material, for example, which may allow drill string joints of varying outer diameter to pass through RCD 40' while maintaining a seal. In an embodiment, lower seal subassembly 43A may be arranged to isolate the wellbore annulus when the wellbore annulus pressure exceeds the riser pressure, that is, under a positive differential pressure. Upper seal subassembly 43B may be arranged to isolate the wellbore annulus when the riser pressure exceeds the wellbore annulus pressure, that is, under a negative differential pressure. More particularly, the outer profiles of elements 46A, 46B may have a generally conical shape so that a differential pressure in the sealing direction acts to compress the element against the drill string to affect a seal. In some embodiments, upper seal subassembly 43B may be similar to lower seal subassembly 43A except inverted in orientation.

Figure 4:
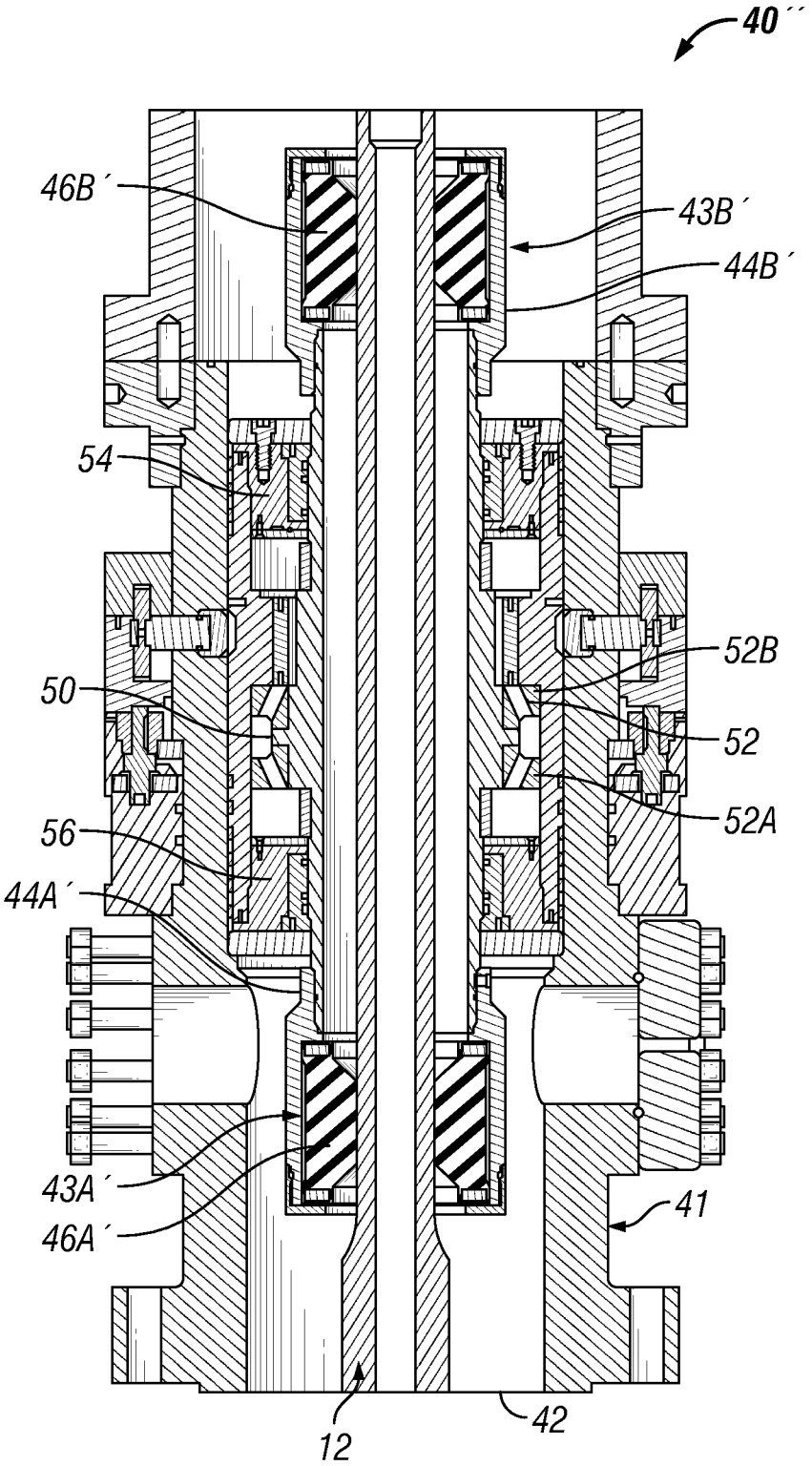
FIG. 4 is an axial cross section of a dual sealing rotating control device according to an embodiment, showing upper and lower seal subassemblies each including a dual-acting resilient element.

FIG. 4 is an elevation view in axial cross section of RCD 40" according to an embodiment, which shares many similarities with RCD 40 of FIG. 2. In particular, RCD 40" of FIG. 4 may include a sleeve 50 that is rotatively mounted within passage 42 by a single thrust bearing assembly 52. In one or more embodiments, thrust bearing assembly 52 may include a lower thrust bearing element 52A and an upper thrust bearing element 52B disposed in proximity to one another at or near the midpoint of sleeve 50. Upper and lower rotary seals 54, 56 may seal sleeve 50 against housing 41 and protect thrust bearing assembly 52. Sleeve 50 may be arranged to receive and seal against drill string 12 with one or more seal assemblies. Sleeve 50 may carry a seal assembly, which may include one or more seal subassemblies 43' with one or more resilient annular sealing elements 46A', 46B' to seal against the external wall of drill string 12, as shown. Sealing elements 46A', 46B' may be made of an elastomeric or polymeric material, for example, which may allow drill string joints of varying outer diameter to pass through RCD 40" while maintaining a seal. A lower seal subassembly 43A' may be carried at a lower end of sleeve 50 and include a resilient element 46A', and an upper seal subassembly 43B' may be carried at an upper end of sleeve 50 and include a resilient element 46B'.

In one or more embodiments, each lower and upper seal subassembly 43A', 43B' may be a bidirectional seal subassembly that is arranged to both isolate the wellbore annulus when the wellbore annulus pressure exceeds the riser pressure, that is, under a positive differential pressure, and to isolate the riser when the riser pressure exceeds the wellbore annulus pressure, that is, under a negative differential pressure. More particularly, as described in greater detail below with respect to FIGS. 5 and 6, interior wall of each element 46A', 46B' may have an hourglass-like shape with upper and lower inward tapered surfaces. Element 46A' 46B' may be captured within a cylindrical retainer 44A', 44B' but allowed to move axially up and down a limited distance within retainer 44A', 44B' under the influence of differential pressures.

Although two bidirectional seal subassemblies 43' are shown in FIG. 4, because each seal subassembly 43' can seal under both positive and negative differential pressure, the seal assembly need only include one seal assembly 43' for RCD 40". Nevertheless, two bidirectional seal subassemblies 43' provide the advantage of redundant sealing capability.

Figure 5:
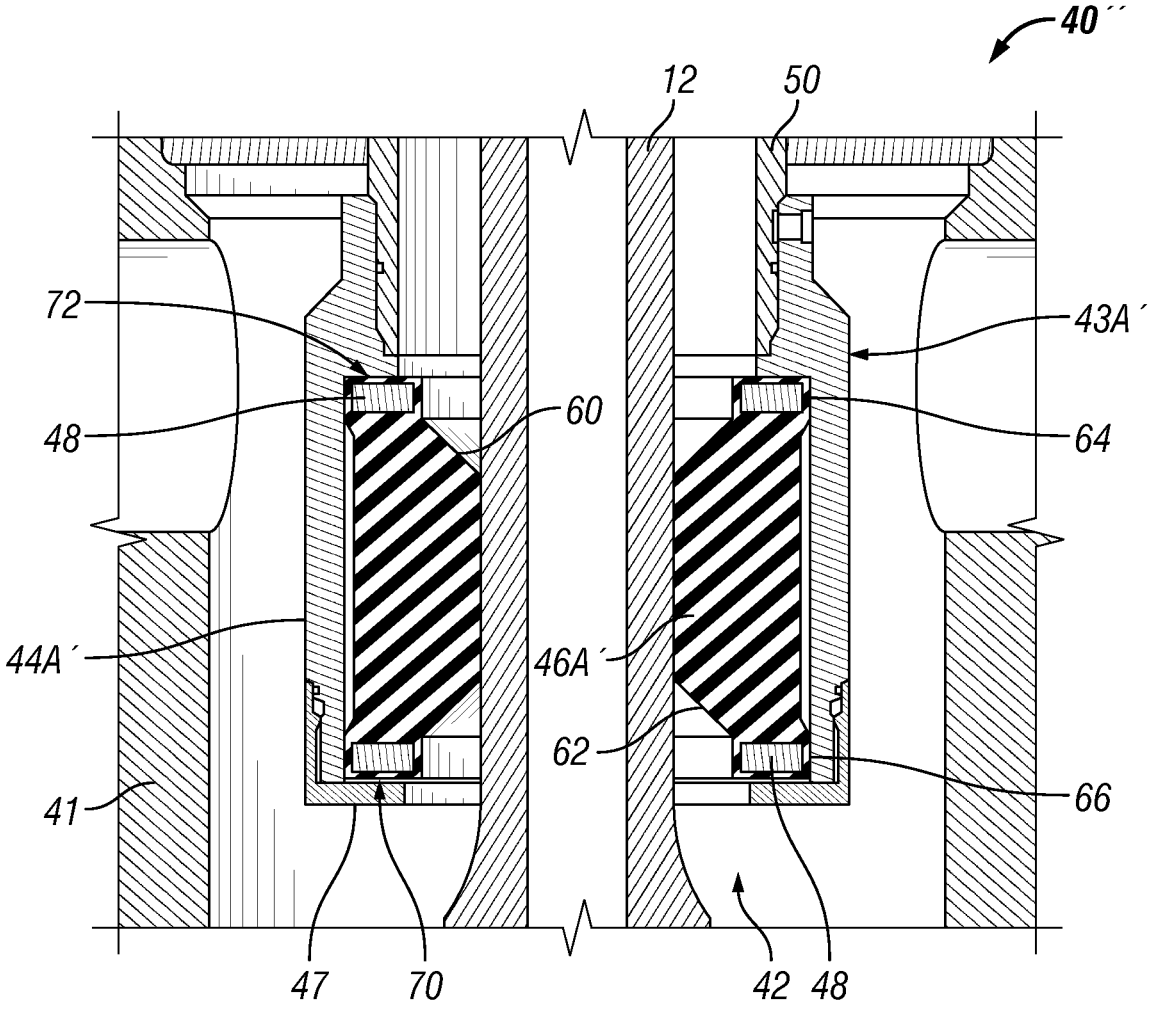
FIG. 5 is an enlarged axial cross section of the dual-acting resilient element of the lower seal subassembly of the rotating control device of FIG. 4, showing the element located in an upper position within a seal retainer for sealing the rotating control device from the well annulus under a positive differential pressure.
Figure 6:
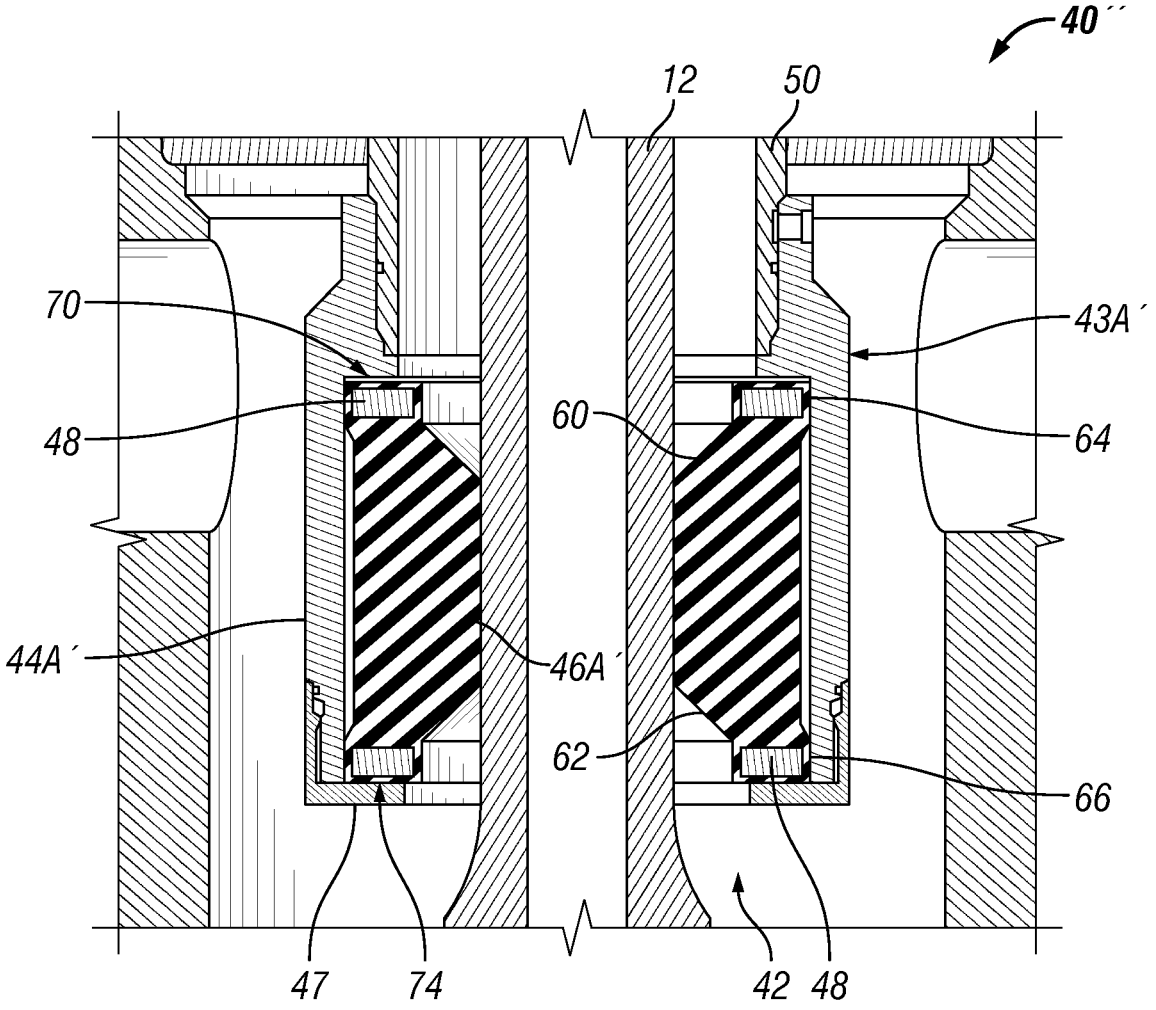
FIG. 6 is an enlarged axial cross section of the dual-acting resilient element of FIG. 5, showing the element located in a lower position within a seal retainer for sealing the well annulus from the rotating control device under a negative differential pressure.

Operation of seal subassemblies 43' is described with reference to exemplary seal subassembly 43A'. FIGS. 5 and 6 show enlarged axial cross sections of the dual-acting, bidirectional lower seal subassembly 43A' of RCD" of FIG. 4. Element 46A' may be slideably captured within cylindrical retainer 44A' by an end cap 47. The axial length of retainer 44A' is slightly longer than the axial length of element 46A', thereby creating a void region 70 within retainer 44A' above and/or below element 46A'. Element 46A' may slide up and down within retainer 44A'.

The interior wall of element 46A' may have an hourglass-like shape with upper and lower inward tapered surfaces 60, 62. The exterior wall of element 46A' may include upper and lower lips 64, 66 having a larger outer diameter than the middle section of element 46A'. Upper and lower lips 64, 66 may be dimensioned to lightly contact and wipe against the inner wall of retainer 44A'. Element 46A' may include upper and lower ring-shaped stiffeners 48 formed therein, which may be positioned near upper and lower lips 64, 66.

Bidirectional sealing may be accomplished by allowing element 46A' to translate within retainer 44A' under the influence of a differential pressure across element 46A' so that void region 70 shifts and exposes an effective piston area at whichever upper or lower side of element 46A' is subject to the greater pressure. Once element 46A' has shifted and is seated against either the upper or lower end of retainer 44A', the applied differential pressure causes element 46A' to compress axially, which in turn results in element 46A' bulging inward radially to form a seal against the outer wall of drill string 12 and outward radially to form a seal at lips 64, 66 against the inner wall of retainer 44A'.

In FIG. 5, element 46A' is shown exposed to a greater pressure from below, so element 46A' has shifted vertically upward and formed a seal against the top of the housing, indicated by arrow 72. Void region 70 between the bottom of element 46A' and the bottom of retainer 44A' (which may be defined by end cap 47) allows the higher pressure fluid to act against the effective piston area of element 46A', resulting in an axially compressive force on element 46A'. This axially compressive force causes the element to bulge to form inner and outer radial seals, as described above.

Similarly, in FIG. 6, element 46A' is shown exposed to a greater pressure from above, so element 46A' has shifted vertically downward and formed a seal against the bottom of the housing (which may be defined by end cap 47), indicated by arrow 74. Void region 70 between the top of element 46A' and the top of retainer 44A' allows the higher pressure fluid to act against the effective piston area of element 46A', resulting in an axially compressive force on element 46A'. This axially compressive force causes the element to bulge to form inner and outer radial seals, as described above.

In summary, a drilling system, rotating control device, and a method for accessing a wellbore have been described. Embodiments of a drilling system may have: A wellhead on a seafloor of a body of water, the wellhead defining a passage; an offshore platform disposed at the surface of the body of water; a string extending from the platform into the wellhead; and a rotating control device having a housing carried atop the wellhead, the housing defining a passage in fluid communication with the passage of the wellhead, the string extending through the passage of the rotating control device and defining a wellbore annulus below the rotating control device, the rotating control device being arranged to form a dynamic seal between the housing and an exterior of the string to isolate the wellbore annulus under both a positive and a negative differential pressure across the seal, the rotating control device including a sleeve rotatively disposed within the housing and rotatively carried near a longitudinal midpoint of the sleeve by a thrust bearing assembly. Embodiments of a rotating control device may have: A housing defining a hollow interior; a sleeve rotatively disposed within the housing and rotatively carried near a longitudinal midpoint of the sleeve by a thrust bearing assembly; and a bidirectional seal assembly operatively coupled to the sleeve and arranged to form a dynamic seal between the sleeve and a tubular longitudinally traveling through the sleeve under both a positive differential pressure and a negative differential pressure across the seal assembly. Embodiments of a method for accessing a wellbore may generally include: Providing a rotating control device in fluid communication with the wellbore; rotatively carrying a sleeve of the rotating control device within a housing of the rotating control device at a midpoint of the sleeve by a thrust bearing assembly; extending a string through a riser into the wellbore, the string and the wellbore defining a wellbore annulus below the rotating control device, the riser being in fluid communication with the rotating control device, the string and the riser defining a riser annulus above the rotating control device; isolating the riser annulus from the wellbore annulus by the rotating control device when a pressure in the riser annulus is greater than a pressure in the wellbore annulus; and isolating the wellbore annulus from the riser annulus by the rotating control device when the pressure in the wellbore annulus is greater than the pressure in the riser.

Any of the foregoing embodiments may include any one of the following elements or characteristics, alone or in combination with each other: A riser extending from the platform to the housing of the rotating control device, the drill string passing through the riser and defining a riser annulus above the rotating control device; the rotating control device being arranged to form a dynamic seal between the housing and an exterior of the string to isolate the riser annulus from the wellbore annulus under both a positive and a negative differential pressure across the seal;

a bidirectional seal assembly operatively coupled to the sleeve and arranged to form a dynamic seal between the sleeve and the string while longitudinally traveling through the sleeve; a first seal retainer coupled to and sealed against the sleeve; a resilient first element slideably disposed within the first seal retainer; the first element is arranged to slide to a first sealing position within the first seal retainer under a positive differential pressure across the first element and to slide to a second sealing position within the first seal retainer under a negative differential pressure across the first element; a second seal retainer coupled to and sealed against the sleeve; a resilient second element slideably disposed within the second seal retainer; the second element is arranged to slide to a first sealing position within the second seal retainer under a positive differential pressure across the second element and to slide to a second sealing position within the second seal retainer under a negative differential pressure across the second element; the first seal retainer is located at a lower end of the sleeve; the second seal retainer is located at an upper end of the sleeve; a resilient first element coupled to and sealed against a lower end of the sleeve and arranged to a dynamic seal between the sleeve and the tubular under a positive differential pressure across the first element; a resilient second element coupled to and sealed against an upper end of the sleeve and arranged to a dynamic seal between the sleeve and the tubular under a negative differential pressure across the second element; the thrust bearing assembly includes an upper thrust bearing element disposed in proximity to a lower thrust bearing element; providing a seal assembly in the rotating control device; and sealing against an exterior of the string by the seal assembly a the string translates through the rotating control device.

The Abstract of the disclosure is solely for providing the patent office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A drilling system comprising:

a wellhead on a seafloor of a body of water, the wellhead defining a passage;

an offshore platform disposed at the surface of the body of water;

a string extending from said platform into said wellhead;

a rotating control device having a housing carried atop the wellhead, the housing defining a passage in fluid communication with the passage of the wellhead, said string extending through said passage of said rotating control device and defining a wellbore annulus below said rotating control device, said rotating control device being arranged to form a dynamic seal between said housing and an exterior of said string to isolate said wellbore annulus under both a positive and a negative differential pressure across said seal, said rotating control device including a sleeve rotatively disposed within said housing and rotatively carried near a longitudinal midpoint of said sleeve by a thrust bearing assembly; and a bidirectional seal assembly operatively coupled to said sleeve and arranged to form a dynamic seal between said sleeve and said string while longitudinally traveling through said sleeve, wherein said seal assembly comprises:

a first seal retainer coupled to and sealed against said sleeve; and a resilient first element slideably disposed within said first seal retainer;

wherein said first element is arranged to slide to a first sealing position within said first seal retainer under a positive differential pressure across said first element and to slide to a second sealing position within said first seal retainer under a negative differential pressure across said first element.

2. The drilling system of claim 1 further comprising:

a riser extending from said platform to the housing of said rotating control device, said drill string passing through said riser and defining a riser annulus above said rotating control device;

said rotating control device being arranged to form a dynamic seal between said housing and an exterior of said string to isolate said riser annulus from said wellbore annulus under both a positive and a negative differential pressure across said seal.

3. The drilling system of claim 1, wherein said seal assembly further comprises:

a second seal retainer coupled to and sealed against said sleeve; and a resilient second element slideably disposed within said second seal retainer; wherein said second element is arranged to slide to a first sealing position within said second seal retainer under a positive differential pressure across said second element and to slide to a second sealing position within said second seal retainer under a negative differential pressure across said second element.

4. The drilling system of claim 3 wherein:

said first seal retainer is located at a lower end of said sleeve; and said second seal retainer is located at an upper end of said sleeve.

5. The drilling system of claim 1 wherein:

said thrust bearing assembly includes an upper thrust bearing element disposed in proximity to a lower thrust bearing element.

6. A drilling system comprising:

a wellhead on a seafloor of a body of water, the wellhead defining a passage;

an offshore platform disposed at the surface of the body of water;

a string extending from said platform into said wellhead; and a rotating control device having a housing carried atop the wellhead, the housing defining a passage in fluid communication with the passage of the wellhead, said string extending through said passage of said rotating control device and defining a wellbore annulus below said rotating control device, said rotating control device being arranged to form a dynamic seal between said housing and an exterior of said string to isolate said wellbore annulus under both a positive and a negative differential pressure across said seal, said rotating control device including a sleeve rotatively disposed within said housing and rotatively carried near a longitudinal midpoint of said sleeve by a thrust bearing assembly; and a bidirectional seal assembly operatively coupled to said sleeve and arranged to form a dynamic seal between said sleeve and said string while longitudinally traveling through said sleeve, wherein said seal assembly comprises:

a resilient first element coupled to and sealed against a lower end of said sleeve and arranged to form a dynamic seal between said sleeve and said tubular under a positive differential pressure across said first element; and a resilient second element coupled to and sealed against an upper end of said sleeve and arranged to form a dynamic seal between said sleeve and said tubular under a negative differential pressure across said second element.

7. A rotating control device comprising:

a housing defining a hollow interior;

a sleeve rotatively disposed within said housing and rotatively carried near a longitudinal midpoint of said sleeve by a thrust bearing assembly; and a bidirectional seal assembly operatively coupled to said sleeve and arranged to form a dynamic seal between said sleeve and a tubular longitudinally traveling through said sleeve under both a positive differential pressure and a negative differential pressure across said seal assembly, wherein said seal assembly comprises:

a first seal retainer coupled to and sealed against said sleeve; and a resilient first element slideably disposed within said first seal retainer;

wherein said first element is arranged to slide to a first sealing position within said first seal retainer under a positive differential pressure across said first element and to slide to a second sealing position within said first seal retainer under a negative differential pressure across said first element.

8. The rotating control device of claim 7, wherein said seal assembly further comprises:

a second seal retainer coupled to and sealed against said sleeve; and a resilient second element slideably disposed within said second seal retainer; wherein said second element is arranged to slide to a first sealing position within said second seal retainer under a positive differential pressure across said second element and to slide to a second sealing position within said second seal retainer under a negative differential pressure across said second element.

9. The rotating control device of claim 8 wherein:

said first seal retainer is located at a lower end of said sleeve; and said second seal retainer is located at an upper end of said sleeve.

10. The rotating control device of claim 7 wherein:

said thrust bearing assembly includes an upper thrust bearing element disposed in proximity to a lower thrust bearing element.

11. A rotating control device comprising:

a housing defining a hollow interior;

a sleeve rotatively disposed within said housing and rotatively carried near a longitudinal midpoint of said sleeve by a thrust bearing assembly; and a bidirectional seal assembly operatively coupled to said sleeve and arranged to form a dynamic seal between said sleeve and a tubular longitudinally traveling through said sleeve under both a positive differential pressure and a negative differential pressure across said seal assembly, wherein said seal assembly comprises:

a resilient first element coupled to and sealed against a lower end of said sleeve and arranged to form a dynamic seal between said sleeve and said tubular under a positive differential pressure across said first element; and a resilient second element coupled to and sealed against an upper end of said sleeve and arranged to form a dynamic seal between said sleeve and said tubular under a negative differential pressure across said second element.

12. A method for accessing a wellbore, comprising:

providing a rotating control device in fluid communication with said wellbore, said rotating control device comprising:

a housing defining a hollow interior;

a sleeve rotatively disposed within said housing; and a bidirectional seal assembly operatively coupled to said sleeve and arranged to form a dynamic seal between said sleeve and a tubular longitudinally traveling through said sleeve under both a positive differential pressure and a negative differential pressure across said seal assembly, wherein said seal assembly includes a first seal retainer coupled to and sealed against said sleeve and a resilient first element slideably disposed within said first seal retainer, said first element arranged to slide to a first sealing position within said first seal retainer under a positive differential pressure across said first element and to slide to a second sealing position within said first seal retainer under a negative differential pressure across said first element;

rotatively carrying the sleeve of said rotating control device within the housing of said rotating control device at a midpoint of said sleeve by a thrust bearing assembly;

extending a string through a riser into said wellbore, said string and said wellbore defining a wellbore annulus below said rotating control device, said riser being in fluid communication with said rotating control device, said string and said riser defining a riser annulus above said rotating control device;

isolating said riser annulus from said wellbore annulus by said rotating control device when a pressure in said riser annulus is greater than a pressure in said wellbore annulus; and isolating said wellbore annulus from said riser annulus by said rotating control device when the pressure in said wellbore annulus is greater than the pressure in said riser annulus.

13. A rotating control device comprising:

a housing defining a hollow interior;

a sleeve rotatively disposed within said housing; and a bidirectional seal assembly operatively coupled to said sleeve and arranged to form a dynamic seal between said sleeve and a tubular longitudinally traveling through said sleeve under both a positive differential pressure and a negative differential pressure across said seal assembly, wherein said seal assembly includes a first seal retainer coupled to and sealed against said sleeve and a resilient first element slideably disposed within said first seal retainer, said first element arranged to slide to a first sealing position within said first seal retainer under a positive differential pressure across said first element and to slide to a second sealing position within said first seal retainer under a negative differential pressure across said first element.

* * * * *